US005165266A

United States Patent [19]

Ginzburg

[11] Patent Number: 5,165,266

[45] Date of Patent: Nov. 24, 1992

[54] CHOCKLESS ROLL SUPPORT SYSTEM

[75] Inventor: Vladimir B. Ginzburg, Pittsburgh, Pa.

[73] Assignees: International Rolling Mill Consultants, Inc.; United Engineering, Inc., Pittsburgh, Pa.

[21] Appl. No.: 787,605

[22] Filed: Nov. 4, 1991

[51] Int. Cl.[5] ..... B21B 13/14; B21B 37/12

[52] U.S. Cl. ..... 72/20; 72/21; 72/241.8; 72/243.2

[58] Field of Search ..... 72/20, 21, 240-243.6, 72/245

[56] References Cited

U.S. PATENT DOCUMENTS

| | | | |
|---|---|---|---|
| 1,787,558 | 1/1931 | Tinsman | 72/242.2 |
| 1,870,509 | 8/1932 | Heiden . | |
| 1,892,933 | 1/1933 | Coryell . | |
| 1,905,129 | 4/1933 | Biggert, Jr. et al. . | |
| 1,972,158 | 9/1934 | Moreland . | |
| 2,792,730 | 5/1957 | Cozzo . | |
| 2,907,235 | 10/1959 | Murakami . | |
| 2,909,088 | 10/1959 | Volkhausen . | |
| 3,373,590 | 3/1968 | Knappe | 72/242.2 |
| 4,041,752 | 8/1977 | Dolene et al. | 72/201 |
| 4,218,905 | 8/1980 | Lehmann et al. | 72/21 |
| 4,270,377 | 6/1981 | Verbickas et al. | 72/247 |
| 4,470,283 | 9/1984 | Schnyder . | |
| 4,491,005 | 1/1985 | Kimura et al. | 72/201 |
| 4,531,394 | 7/1985 | Turley et al. | 72/243.4 |
| 4,543,810 | 10/1985 | Stoy et al. | 72/245 |
| 4,552,008 | 11/1985 | Schlatter et al. . | |
| 4,627,261 | 12/1986 | Schiller | 72/247 |
| 4,631,948 | 12/1986 | Bald et al. . | |
| 4,691,548 | 9/1987 | Richter et al. | 72/21 |
| 4,724,698 | 2/1988 | Ginzburg . | |
| 4,736,678 | 4/1988 | Stotz . | |
| 4,744,235 | 5/1988 | Schiller | 72/247 |
| 4,781,050 | 11/1988 | Winter et al. . | |
| 4,803,865 | 2/1989 | Jansen et al. | 72/245 |
| 5,007,273 | 4/1991 | Kummerhoff | 72/242.2 |

FOREIGN PATENT DOCUMENTS

| | | |
|---|---|---|
| 416880 | 9/1990 | European Pat. Off. . |
| 60-18211 | 1/1985 | Japan . |
| 60-210307 | 10/1985 | Japan . |
| 1509147 | 2/1988 | U.S.S.R. . |

*Primary Examiner*—Lowell A. Larson
*Assistant Examiner*—Thomas C. Schoeffler
*Attorney, Agent, or Firm*—Armstrong & Kubovcik

[57] ABSTRACT

A chockless work roll support and positioning apparatus and method comprises a pair of brackets for each end of each work roll and having a pair of work roll support rollers rotatably mounted on each bracket. Each bracket is connected to at least one actuator means, such as a hydraulic piston/cylinder assembly, preferably one actuator means for each support roller. The actuator means are actuated through a servovalve, by position or pressure signals to position the support rollers at desired positions and to exert a desired pressure between the respective support rollers and the corresponding work rolls. By such signal control, the work rolls may be balanced, bent in the upstream or downstream horizontal direction, upwardly or downwardly, or may be placed in offset or cross-rolling position.

23 Claims, 6 Drawing Sheets

CHOCKLESS ROLL SUPPORT SYSTEM

BACKGROUND

Work rolls of 4-high, 5-high and 6-high rolling mills presently are provided with chocks (chucks) with bearings to support the ends of the work rolls. Such chocks serve to hold the rolls in appropriate positions in the mill stand and to transmit the roll balance and bending forces which are applied to the chocks by means of hydraulic cylinders.

This requires that each roll have two chocks which must be removed when the associated rolls are removed for regrinding and refinishing and replaced when such repair and maintenance procedures are completed. Such procedures are difficult, time-consuming and expensive.

Moreover, existing roll bending and balancing arrangements are complicated in that the roll bending and balance cylinders usually are mounted inside the work roll chocks, the backup roll chocks, Mae West blocks or E-blocks attached to the mill housing posts. In order to provide off setting of the rolls, it is necessary to place shims between the chocks and the housing posts. Special mechanisms are required to provide a roll crossing configuration.

FIELD OF THE INVENTION

This invention provides a chockless roll support system which avoids the problems associated with prior art roll chock and bearing arrangements and by means of which a number of functions can be carried out with a single roll support system without the need for special mechanisms. Thus, in accordance with the present invention, a single support mechanism is used to achieve roll balance, both positive and negative roll bending in the vertical plane, both upstream and downstream roll bending in the horizontal plane, roll off-setting and roll crossing.

BRIEF DESCRIPTION OF THE DRAWINGS

FIG. 1(*b*) is a similar elevational view illustrating, n exaggerated scale, positive roll bending in the vertical plane.

FIG. 1(*c*) is a similar elevational view illustrating negative roll bending in the vertical plane.

FIG. 1(*d*)is a top plan view, in sketch form, of a rolling mill work roll and a workpiece and illustrating, in exaggerated scale, roll bending in the horizontal plane.

FIG. 1(*e*) is a similar plan view illustrating downstream roll bending in the horizontal plane.

FIG. 1(*f*) is an elevational view, in sketch form, or a 4-high rolling mill, illustrating work roll off-setting.

FIG. 1(*g*) is a top plan view, in sketch form, illustrating work roll crossing.

DETAILED DESCRIPTION OF THE PREFERRED EMBODIMENT

FIGS. 1(*g*) thru 1(*g*) are illustrative of modes of operation individually known to the prior art and all of which modes can be performed by the present invention.

Figure 1A:
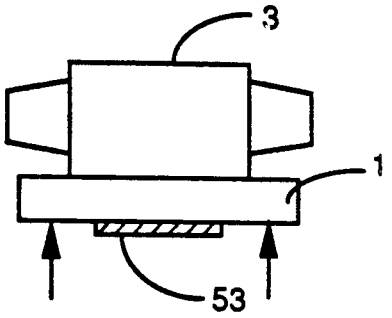
FIG. 1(*a*) is an elevational view showing, in sketch form, a top backup roll, a top work roll and a workpiece, and illustrating roll balance.
Figure 1D:
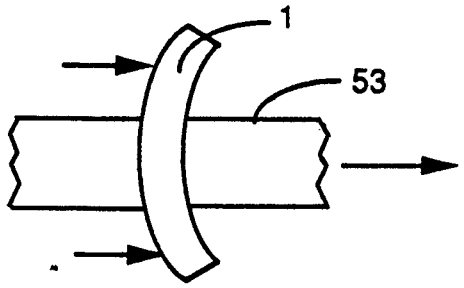
Figure 1B:
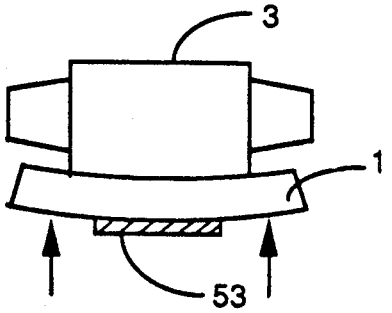
Figure 1E:
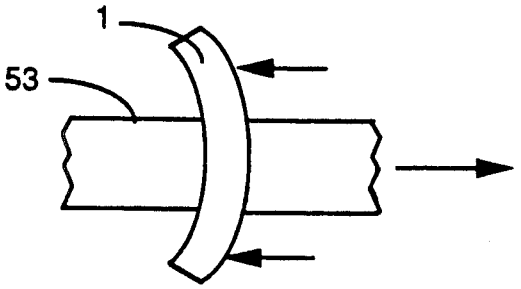
Figure 1C:
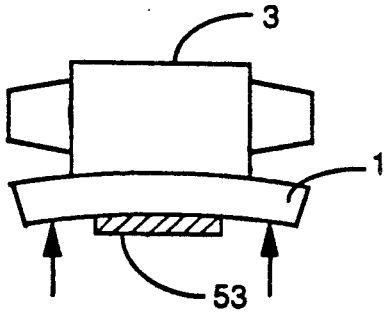
Figure 1F:
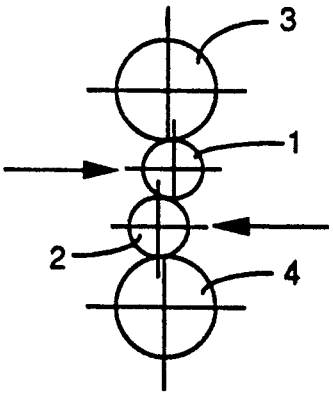
Figure 1G:
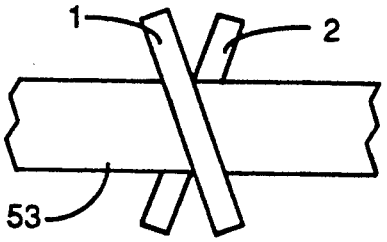
Figure 2:
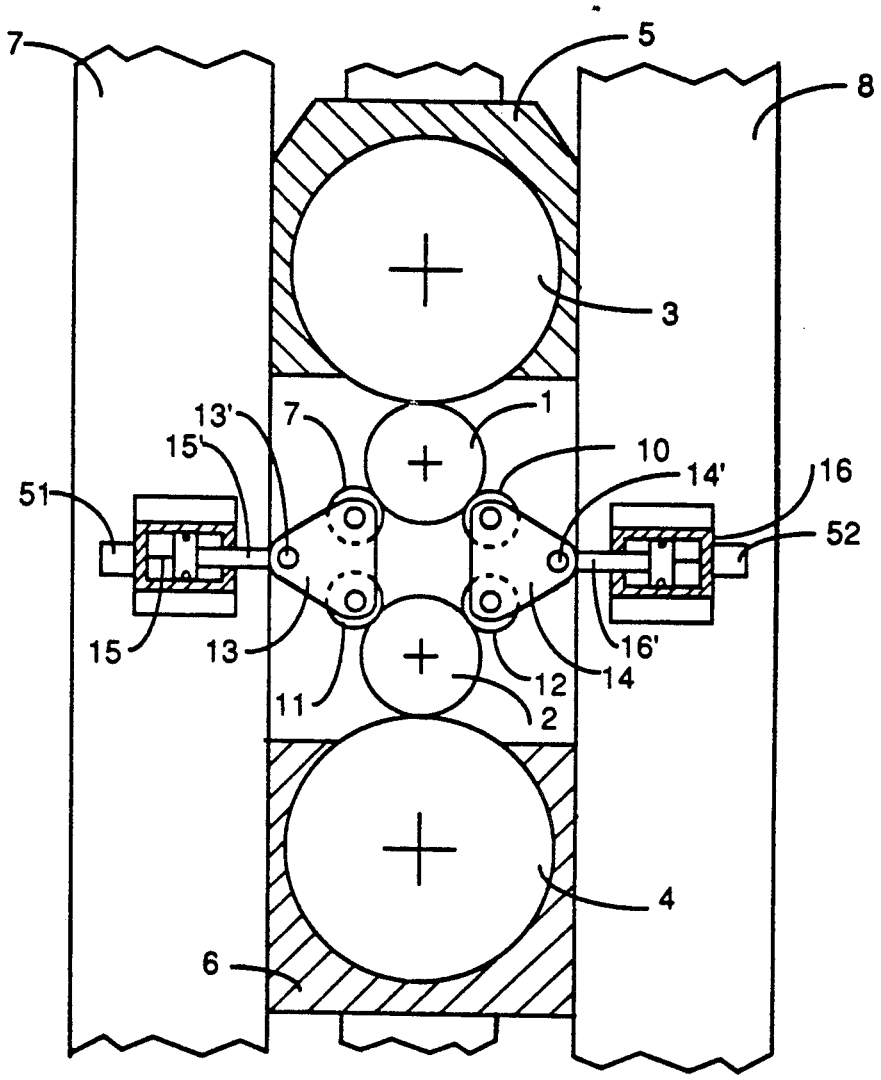
FIG. 2 is a side elevational view of a 4-high mill showing one form of the chockless roll support system of the invention.
Figure 3:
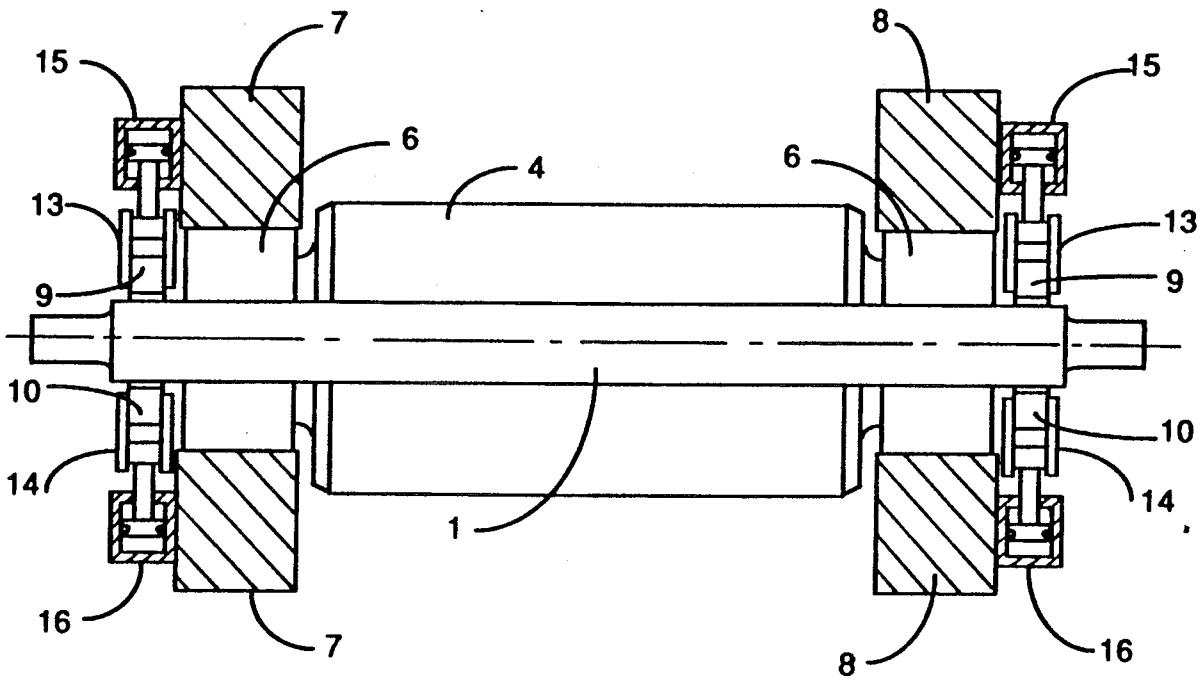
FIG. 3 is a top plan view of the mill shown in FIG. 2, partly in cross section and with the top backup roll removed for clarity.

As shown in FIGS. 2 and 3, in one embodiment, the invention may comprise two pairs of roll bending and balance rollers 9 and 11 and 10 and 12 rotatably mounted, respectively, on roller supports 13 and 14, and bearing against a pair of work rolls, i.e. an upper work roll 1 and a lower work roll 2. The upper work roll 1 is backed up by means of a top backup roll 3 mounted in a top backup roll chock 5 which is mounted in rolling mill housing posts 7 and 8, and the lower work roll is backed up by a bottom backup roll 4 mounted in a bottom backup roll chock 6 also mounted in posts 7 and 8.

Roller support brackets 13 and 14 are pivotally connected, by pins 13' and 14', to pistons 15' and 16' of roll bending and balance cylinders 15 and 16 provided with cylinder piston position transducers 51 and 52.

Work rolls 1 and 2 thus are supported between backup rolls 3 and 4 by means of roll bending and balance rollers 9, 10, 11 and 12 which are forced against the work rolls by forces applied to the roller support brackets 13 and 14 by means of the piston cylinder assemblies 15/15' and 16/16'.

With the embodiment of FIGS. 2 and 3, positive roll bending forces can be applied to the work rolls [as in FIG. 1(*b*)] which also can be off-set as shown in FIG. 1(*f*) and placed in cross roll position as shown in FIG. 1(*g*).

Figure 4:
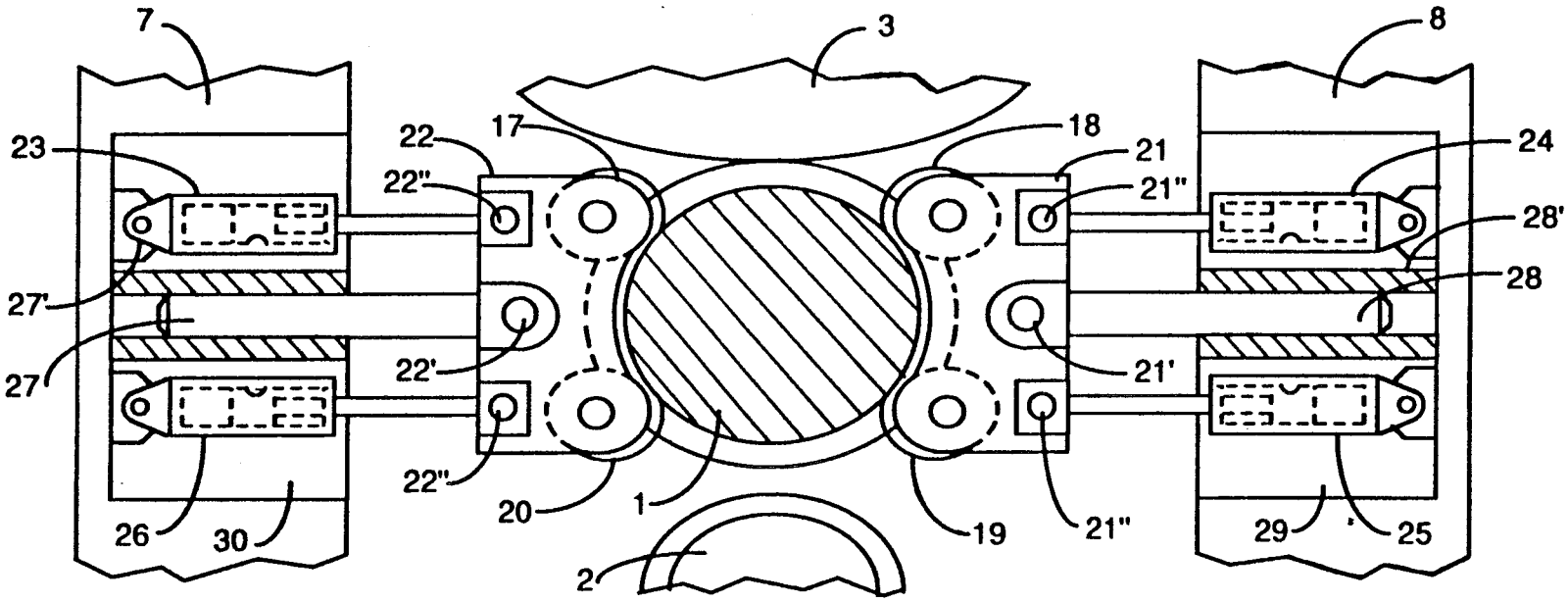
FIG. 4 is a side elevational view, partly in cross-section, of a portion of a rolling mill and illustrating another embodiment of the roll support system of the invention.
Figure 5:
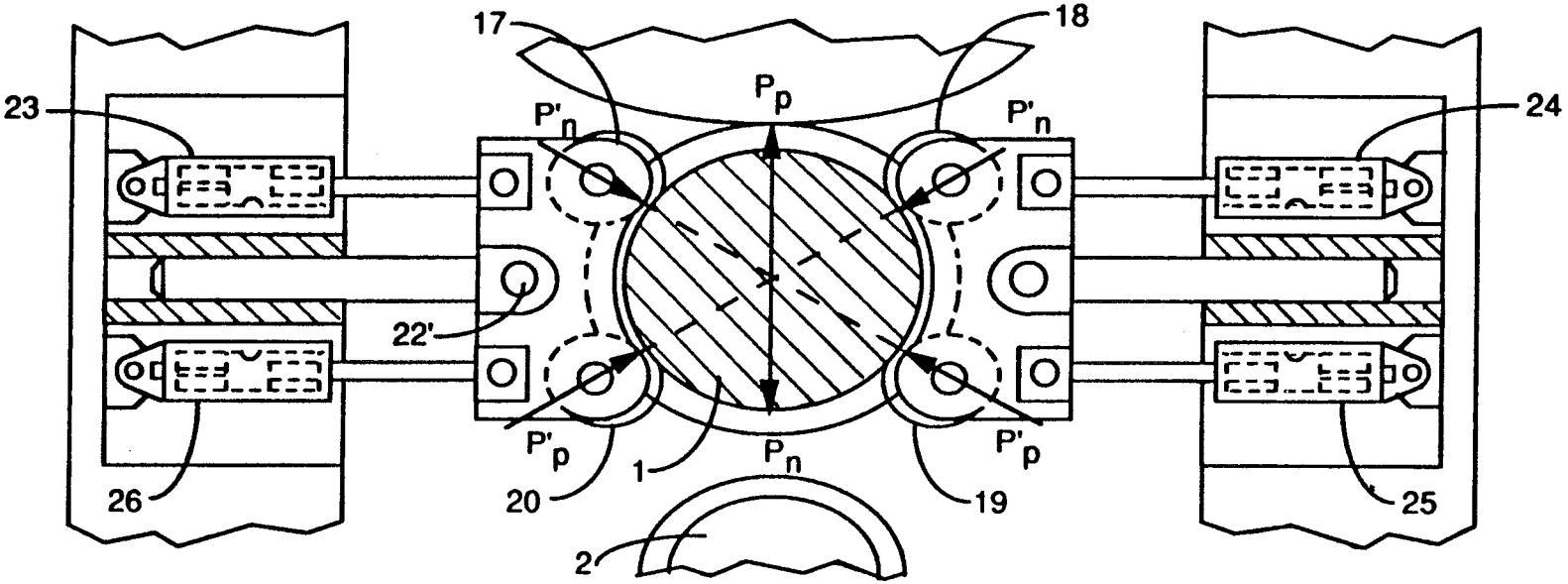
FIG. 5 is another view of the mill and roll support system shown in FIG. 4, and showing in diagrammatic form, forces applied to a work roll in accordance with the present invention.
Figure 6:
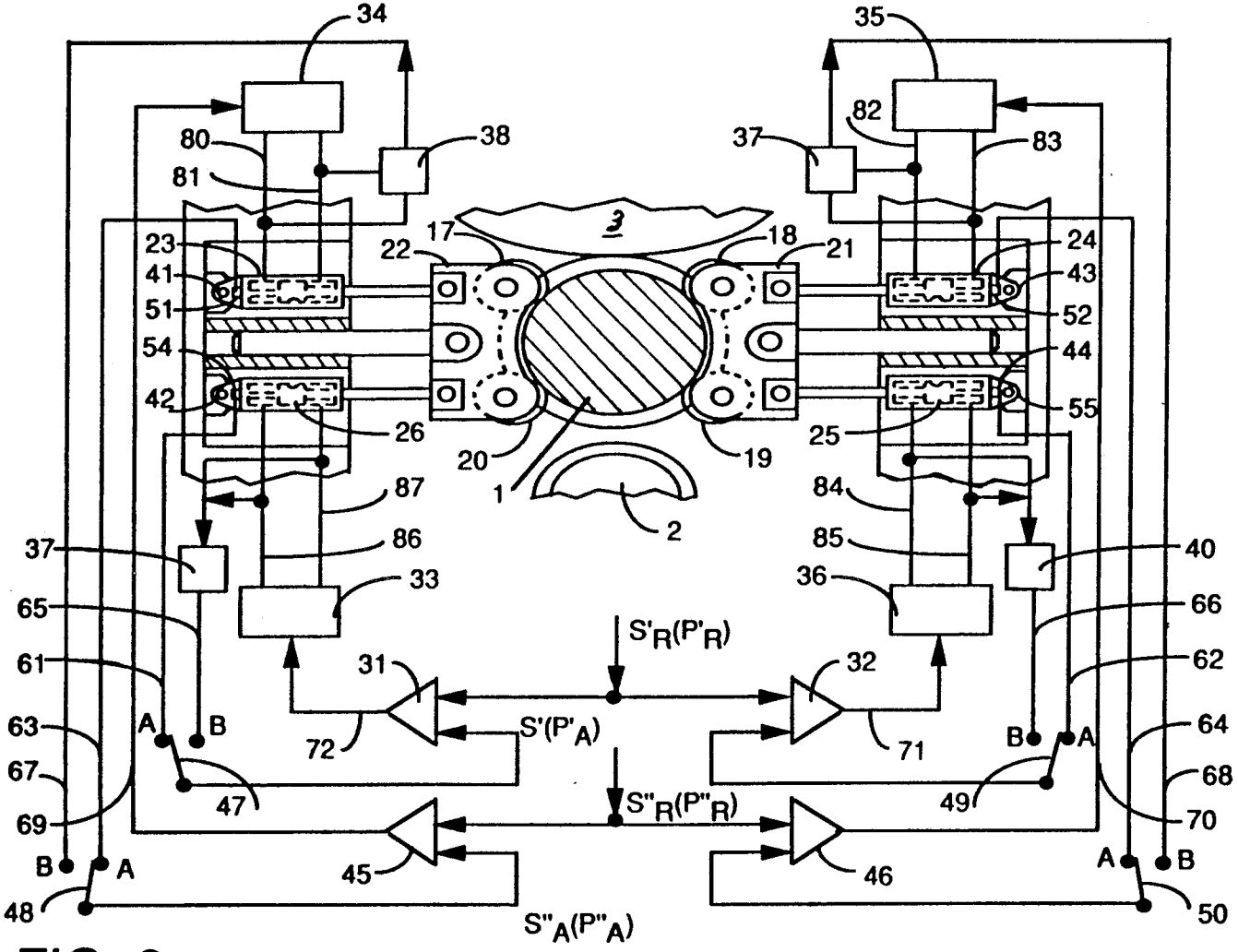
FIG. 6 is a further view of a portion of a mill as shown in FIG. 4, together with associated control elements of the system in accordance with the invention.

FIGS. 4, 5 and 6 show another embodiment of the invention in which each of the work rolls is supported by pairs of upper, negative roll bending rollers and pairs of lower, positive roll bending and balance rollers For simplicity, in these drawings, only one end of the upper work roll is shown. However, it is to be understood that each end of each of the work rolls is supported by rollers as shown in these Figs. Unless otherwise indicated, reference to the illustrated rollers is to be understood to include such other rollers which together comprise the chockless roll support system of this invention. In FIGS. 4, 5 and 6, the upper or negatively acting rollers are rollers 17 and 18 and the lower, positively acting rollers are rollers 19 and 20. In this embodiment of the invention, the roller pairs are mounted in roller support brackets 21 and 22 which are respectively pivotally connected, by pins 21' and 22', to guide rods 28 and 27 mounted in guideways 28' and 27' mounted on posts 8 and 7. Support brackets 21 and 22 also are pivotally connected, by pin pairs 21'' and 22'' to the pistons of piston cylinder assemblies 23, 24, 25, and 26. Similar supports, pins, guide rods and guideways and piston/-cylinder assemblies are provided for the rollers at the other end of the upper work roll and at each end of the lower work roll.

Rollers 17 and 18 serve a negative roll bending function and rollers 19 and 20 serve as positive roll bending and balance rollers, as shown in FIG. 5 where the arrow $P_p$ indicates the direction of positive roll bending and balance forces, $P_n$ indicates the direction of negative roll bending forces; $P_{p'}$ indicates the direction of the force component generated by the positive roll bending and balance cylinders 25 and 26 and $P_{n'}$ indicates the direction of the force component generated by the negative roll bending cylinders 23 and 24.

Turning next to FIG. 6, that Fig. shows an arrangement for control of the position of the support rollers in a position mode (A) and of the pressure applied to the support rollers in a pressure mode (B).

Switches 47, 48, 49 and 50 are provided for operation in each such mode.

Each of the hydraulic piston cylinder assemblies 23, 24, 25 and 26, comprising position-sensing transducers, 51, 52, 54, 55, is connected to a cylinder position/pressure regulator through a servovalve and a pressure transducer.

As previously stated, piston cylinder assemblies 23 and 24 serve for application of negative roll bending forces. Thus, for operation in the position mode (A), regulator 45 is connected through line 69 to servovalve 34, and through hydraulic fluid supply lines 80 and 81 to hydraulic piston/cylinder assembly 23. An actual position signal $S''_A$ is received from position displacement transducer 51, and input, through line 63 and switch 48, to negative roll bending hydraulic cylinder position/-pressure regulator 45, together with a reference position signal $S''_R$. The resulting error signal is transmitted by line 69 to servovalve 38 which causes hydraulic fluid to be forced through lines 80 and 81 into the hydraulic piston/cylinder assembly for positioning roller 17 in a desired position. For operation in the pressure mode (B), an actual pressure signal, $P''_A$, is received through lines 80 and 81 from pressure transducer 38, transmitted through line 67 and switch 48 and input to regulator 45 together with a reference signal, $P''_R$. The resulting error signal is transmitted through line 69 to servovalve 34 which causes hydraulic fluid to be forced through lines 80 and 81 into the piston/cylinder assembly until a desired pressure on roller 17 is attained.

Piston cylinder assembly 24 similarly is connected for operation in the position modes (A) and (B). In the position mode (A), an actual signal $S''_A$ is transmitted from position displacement transducer 52, line 64 and switch 50 to negative roll bending hydraulic cylinder position/pressure regulator 46, together with a reference signal $S''_R$. The resulting error signal is transmitted through line 70 to servovalve 35 which cause hydraulic fluid to be introduced into the hydraulic piston/cylinder assembly 24 through lines 82 and 83 so that a desired position of roll 18 is established. For operation in the pressure mode (B), an actual pressure signal, $P''_A$, is received through lines 82 and 83 from pressure transducer 39, transmitted through line 68 and switch 49 and input to regulator 46 together with a reference signal, $P''_R$. The resulting error signal is transmitted through line 70 to servovalve 35 which causes hydraulic fluid to be forced through lines 82 and 83 into the piston/cylinder assembly 24 until a desired pressure on roller 18 is attained.

The positive roll bending and balance piston cylinder assembly 26 similarly is connected for operation in the position modes (A) and (B). In the position mode (A), an actual signal $S'_A$ is transmitted from position displacement transducer 54, line 61 and switch 47 to negative roll bending hydraulic cylinder position/pressure regulator 31, together with a reference signal $S'_R$. The resulting error signal is transmitted through line 72 to servovalve 33 which causes hydraulic fluid to be introduced into the hydraulic piston/cylinder assembly 26 through lines 86 and 87 so that a desired position of roller 20 is established. For operation in the pressure mode (B), an actual pressure signal, $P'_A$, is received through lines 86 and 87 from pressure transducer 37, transmitted through line 65 and switch 47 and input to regulator 31 together with a reference signal, $P'_R$. The resulting error signal is transmitted through line 72 to servovalve 33 which causes hydraulic fluid to be forced through lines 86 and 87 into the piston/cylinder assembly 26 until a desired pressure o roller 20 is attained.

The other positive roll bending and balance piston cylinder assembly 25 is similarly connected for operation in the position modes (A) and (B). In the position mode (A), an actual signal $S'_A$ is transmitted from position displacement transducer 55, line 62 and switch 49 to negative roll bending hydraulic cylinder position/-pressure regulator 32, together with a reference signal $S'_R$. The resulting error signal is transmitted through line 71 to servovalve 36 which cause hydraulic fluid to be introduced into the hydraulic piston/cylinder assembly 25 through lines 84 and 85 so that a desired position of roll 19 is established. For operation in the pressure mode (B), an actual pressure signal, $P'_A$, is received through lines 84 and 85 from pressure transducer 40, transmitted through line 66 and switch 49 and input to regulator 32 together with a reference signal, $P'_R$. The resulting error signal is transmitted through line 71 to servovalve 36 which causes hydraulic fluid to be forced through lines 84 and 85 into the piston/cylinder assembly 25 until a desired pressure on roller 19 is attained.

The position mode (A) is used during changing of the work rolls or the roll bending and balance rollers. In operation, to position the roll bending and balancing rollers for removal of the work rolls, switches 47, 48, 49 and 50 are set in the position mode (A) and desired position reference signals $S'_R$ and $S''_R$ are impressed, from a computer or other suitable information source (not shown), on hydraulic cylinder regulators 31, 32, 45 and 46. Such references signals are compared with actual position signals $S'_A$ and $S''_A$ received by the respective regulators through lines 61, 62, 63 and 64 and a necessary corrective signal is sent by the regulators to servovalves 33, 34, 35 and 36 to effect adjustment of the cylinder pistons to the desired "open" positions.

After changing rolls, this sequence of events is repeated using reference signals $S'_R$ and $S''_R$ selected to move the roll bending and balance rollers toward a "closed" position until actual pressure signals $P'_A$ and $P''_A$ are reached via pressure transducers 37, 40 (for positive roller action) or 38 and 39 (for negative roller action) and signal transmitting lines 65 and 66 (from the positively acting piston cylinder assemblies 26 and 25) and signal transmitting lines 67 and 68 (from the negatively acting piston cylinder assemblies 23 and 24). Switches 47, 48, 49 and 50 then are set to the pressure mode (B), and reference signals $P'_R$ and $P''_R$ are impressed on the regulators 31, 32, 45 and 46 from a computer or other suitable information source (not shown).

As seen particularly in FIG. 3, the roll bending and balancing rollers abut the work rolls adjacent the respective ends, inboard of the roll necks to which torque is applied by a suitable mechanism (not shown). By application, through rollers 9, 10, 11 and 12 of the apparatus of FIG. 2, or through rollers 17, 18, 19 and 20 of FIG. 4 (and comparable rollers at the other end of the upper work roll and at the ends of the lower work roll), of balanced forces of appropriate magnitude, those rolls are balanced as shown in FIG. 1(*a*).

By positioning the positively (upwardly) acting rollers, e.g. rollers 19 and 20, (and a corresponding set of rollers at the other end of the work roll) relatively closer to the vertical plane extending through the centerline of the unbent work roll 1 (the vertical reference plane), and the negatively (downwardly) acting rollers, e.g. rollers 17 and 18, relatively farther from the vertical reference plane, the work roll is bent, within the stress-strain limits of the roll, upwardly in a vertical plane, as shown in FIG. 1(*b*). Conversely, by positioning the negatively (downwardly) acting rollers relatively closer to the vertical reference plane and the positively (upwardly) acting rollers relatively farther from the vertical reference plane, the work roll is bent downwardly in a vertical plane, as shown in FIG. 1(*c*).

By positioning the upstream set of rollers, e.g. rollers 18 and 19 (FIG. 4) (and a corresponding set of rollers at the other end of the work roll 1) relatively closer to a horizontal plane extending through the centerline of the unbent work roll (the horizontal reference plane) and the downstream set of rollers, e.g. rollers 17 and 20 (and a corresponding set of rollers at the other end of the work roll) relatively farther from the horizontal reference plane, the work roll is bent in an upstream direction in a horizontal plane, as shown in FIG. 1(*d*). By reversing the positions of the respective sets of rollers, i.e. the upstream rollers relatively farther from the horizontal reference plane and the downstream rollers relatively closer to the horizontal reference plane, the work roll is bent in a downstream direction in a horizontal plane, as shown in FIG. 1(*e*).

By off-setting the roller pairs 17/20 and 18/19 from the vertical plane extending through the centerline of the upper backup roll and by similarly off-setting, in opposite directions, roller pairs supporting a lower work roll, and by similarly positioning similar pairs of rollers at the other end of the upper work roll, and by similarly supporting the ends of a lower work roll, the upper and lower work rolls are off-set in the manner shown in FIG. 1(*f*).

By skewing the upper and lower work rolls in opposite directions as shown in FIG. 1(*g*) a cross-rolling configuration is obtained. Such configuration can be achieved with the present invention by off-setting the roller sets 17 and 20 and 18 and 19 from a vertical plane extending through the centerline of the upper backup roll and the corresponding roller set at the other end of the work roll 1 being off-set the same distance from that plane but in the opposite direction. The corresponding roller sets supporting the lower roll are similarly positioned but in opposite senses, as shown in FIG. 1(*g*).

Maintenance of a desired work roll position is achieved by feedback of actual piston cylinder assembly position and pressure signals generated by the position displacement and pressure transducers to the position/-pressure regulators 31, 32, 45 and 46 and by regulatory control signals sent from the regulators to servovalves 33, 34, 35 and 36 to correct deviations of piston cylinder assembly position and pressure from desired values of those parameters.

By means of such positioning and/or bending of the work rolls, control of the shape of a workpiece 53 (FIG. 1) being rolled is achieved.

What is claimed is:

1. In a metal strand rolling mill having at least one pair of upper and lower work rolls and at least one pair of larger upper and lower backup rolls, a chockless work roll apparatus for supporting and controlling position of and pressure applied to a set of work rolls otherwise unsupported at their respective extremities, comprising:

a. a pair of roller support brackets juxtaposable to an upstream and a downstream portion of each end of each work roll;

b. a pair of work rolls support rollers mounted on a first end of each bracket proximate to a corresponding work roll;

c. actuator means for each support roller, said actuator means being connected at a second end of each bracket remote from a corresponding work roll, to engage and disengage the support rollers with respect to a corresponding work roll, and d. control means for each support roller to control position of and pressure applied by the support rollers to a corresponding work roll, whereby, by actuation of the actuator means, the work rolls may be balanced, bent in an upstream or a downstream horizontal direction, bent in an upward or a downward direction, placed in a horizontally offset position with respect to a vertical plane through horizontal axes of the backup rolls, or placed in a cross-rolling position.

2. Apparatus according to claim 1, wherein each support bracket is pivotally connected to two corresponding actuator means and is pivotally connected, between the connections to the actuator means, to a guide pin slidable in a guideway in an upstream and a downstream direction.

3. Apparatus according to claim 2, wherein the respective actuator means are hydraulic piston/cylinder means.

4. Apparatus according to claim 3, further including means to determine a position of the piston in the hydraulic means.

5. Apparatus according to claim 4, further including signal generating means to control a position of the piston in the hydraulic means in accordance with a difference between a actual position of the piston and a desired position of the piston.

6. Apparatus according to claim 5, wherein the signal generating means is a position transducer, and the apparatus further comprises a servovalve to actuate the hydraulic means in accordance with a position difference signal.

7. Apparatus according to claim 5, further comprising signal generating means to control the pressure exerted by the support rollers against the work roll in accordance with a difference between a actual pressure and a desired pressure.

8. Apparatus according to claim 7, wherein the signal generating means is a pressure transducer, and the apparatus further comprises a servovalve to actuate the hydraulic means in accordance with a pressure difference signal.

9. In a method of rolling metal strand in a rolling mill having at least one pair of upper and lower work rolls having a neck at each end thereof and a rolling surface between the working roll necks and at least one pair of upper and lower backup rolls, the steps comprising:

a. leaving the necks of the work rolls unsupported;

b. providing a pair of roller support brackets juxtaposable to an upstream and a downstream portion of each end of each work roll inboard of the work roll necks;

b. mounting a pair of work roll support rollers on a first end of each bracket proximate to a corresponding work roll;

c. pivotally connecting an actuator means to a second end of each bracket remote from a corresponding work roll, for engaging and disengaging the support rollers with respect to a corresponding work roll, and d. controlling the position of and the pressure applied by the support rollers to the corresponding work roll.

10. A method according to claim 9, further comprising providing an actuator means corresponding to each support roller.

11. A method according to claim 10, further comprising generating a signal representing the difference between an actual position of the work rolls and a desired position of the work rolls and controlling the position of the work rolls in accordance with such signal.

12. A method according to claim 11, further comprising transmitting the signal to a servovalve and changing the position of the support rollers and the corresponding work rolls by actuating the servovalve and a corresponding position changing means connected to the servovalve.

13. A method according to claim 10, further comprising generating a signal representing the difference between an actual pressure between the work rolls and the support rollers and a desired pressure between the work rolls and the support rollers, and controlling the pressure between the work rolls and the support rolls in accordance with such signal.

14. A method according to claim 13, further comprising transmitting the signal to a servovalve and changing the pressure between the support rollers and the corresponding work rolls by actuating the servovalve and a corresponding pressure changing means connected to the servovalve.

15. A method of supporting and controlling the position and type and extent of axial deflection of at least one pair of work rolls in a rolling mill having upper and lower backup rolls, said method comprising:

1. a supporting each work roll by a pair of upstream and a pair of downstream support rollers respectively juxtaposable to upstream and downstream work roll surfaces;

b. mounting each pair of support rollers on a bracket;

c. pivotally connecting each bracket to a pair of bracket actuating means corresponding respectively to an upper support roller and a lower support roller;

d. pivotally connecting each bracket, between the connections to the bracket actuating means, to one end of a guide pin slidable in a guideway in a upstream direction and a downstream direction, whereby each bracket is movable in an upstream and a downstream direction and about the respective pivots;

e. sensing actual positions of the bracket actuating means and the corresponding support rollers;

f. generating signals representing desired positions of the support rollers and the differences between the actual and desired positions of the support rollers;

g. sensing actual pressures between the respective support rollers and the corresponding work rolls;

h. generating signals representing differences between actual pressures and pressures required to position the support rollers at desired positions, and i. controlling the positions of the support rollers in accordance with such difference signals.

16. A method according to claim 15, wherein, in accordance with the sensed actual positions of the support rollers, a position difference signal is generated to move the upstream and the downstream support rollers apart to an open position for removal of the work rolls and to move the upstream and downstream support rolls to a closed position for remounting of the work rolls.

17. A method according to claim 15, wherein pressure difference signals are generated to balance the work rolls.

18. A method according to claim 15, wherein pressure difference signals are generated to effect a positive work roll bending in a vertical plane.

19. A method according to claim 15, wherein pressure difference signals are generated to effect a negative work roll bending in a vertical plane.

20. A method according to claim 15, wherein pressure difference signals are generated to effect an upstream work roll bending in a horizontal plane

21. A method according to claim 15, wherein pressure difference signals are generated to effect a downstream work roll bending in horizontal plane.

22. A method according to claim 15, wherein pressure difference signals are generated to effect an offsetting of the work rolls from a vertical plane extending through horizontal axial centerlines of the backup rolls.

23. A method according to claim 15, wherein pressure difference signals are generated to effect a cross-rolling position of the work rolls.

* * * * *